US005150835A

United States Patent [19]

Yamamoto

[11] Patent Number: 5,150,835

[45] Date of Patent: Sep. 29, 1992

[54] RAIL SUPPORT ADJUSTING AND FASTENING DEVICE

[76] Inventor: Akio Yamamoto, 1602-banchi, Kyoden, Fukui-shi, Fukui-ken, Japan

[21] Appl. No.: 594,131

[22] Filed: Oct. 10, 1990

[51] Int. Cl.[5] ..... E01B 9/66

[52] U.S. Cl. ..... 238/50; 238/7; 238/281; 238/282

[58] Field of Search ..... 238/2, 6, 7, 29, 50, 238/51, 52, 53, 281, 310, 282

[56] References Cited

U.S. PATENT DOCUMENTS 4,616,395 10/1986 Farese et al. ..... 238/7 X

FOREIGN PATENT DOCUMENTS 2345960 5/1975 Fed. Rep. of Germany ..... 238/7

*Primary Examiner*—Frank E. Werner
*Assistant Examiner*—James Eller
*Attorney, Agent, or Firm*—Edwin E. Greigg; Ronald E. Greigg

[57] ABSTRACT

A rail support adjusting and fastening device according to the present invention is used in such a state that tilting of each of the rails and the gage of a track are briefly adjusted in advance by connecting members (cross ties and the like) for connecting parallel rails to one another when the track is directly laid onto a concrete bed as a direct fastened track.

3 Claims, 8 Drawing Sheets

RAIL SUPPORT ADJUSTING AND FASTENING DEVICE

BACKGROUND OF THE INVENTION (a) Field of the Invention

The present invention relates to a rail support adjusting and fastening device which is used in such a state that tilting of each of the rails and the gage of a track are briefly adjusted in advance by means of connecting members such as cross ties for connecting parallel rails to one another when the track is directly laid onto a concrete bed as a direct fastened track.

(b) Description of the Prior Art

As a rail support device, which is used independently, for the parallel rails in laying a direct fastened track, such a rail support device has been proposed as shown in FIGS. 6 and 7. Namely, a rail support device a is constructed as follows. A support plate e is made to present a rectangular shape and provides a support surface portion d for supporting a bottom portion c of a rail b. A screw hole f is formed respectively with both of the inside and outside portions of the support plate e to extend vertically. A support bolt h is formed to have an upper screw portion g at the upper portion thereof and formed to be a tapered bar at the lower portion thereof to slender gradually in a direction of the lower end thereof. The support bolt h is screwed with the screw hole f by means of the upper screw portion g. The height of the support plate may be adjusted by changing the screwing conditions of the support bolt h. An inside portion and an outside portion of upper surfaces m of the bottom portion c may be pressed by means of a forward end pressing portion k of each of pressing washers j in such a manner that nuts i screwed with the upper screw portions g of the support bolts h, press the pressing washers j. With the pressing of the pressing washers j, the rail support device a may be integral with the rail b. .

As shown in FIG. 8, the rail support device a as constructed above, may be mounted respectively on the parallel rails b in opposite positions in such a state that the gage and tilting of the rails b have been adjusted briefly in advance. Thus, height and low of the rails and cant or superelevation of the outer rail at turning points have been adjusted in cooperation with both the rail support devices a.

However, according to the above-mentioned rail support devices, it cannot support and fix a skeleton of track o stably, and therefore, the following problems have occurred. Namely, it is very difficult to carry out an adjusting operation precisely. Further, its adjusting operation is inefficient and laying cost of a direct fastened tract becomes high and a long period is required for laying the direct fastened tract.

Now, the above mentioned problems will be described in detail below together with their causes.

The above-mentioned rail support device involves the following unstable factors (A)~(C)X:

(A) It is difficult to manufacture the under surface p of the rail bottom portion c to be plane perfectly and also it is practically impossible to finish the support surface d of the support plate to be plane perfectly. Therefore, where the rail bottom c is supported by the support surface d, perfect face to face contact cannot be obtained between the support surface d and the under surface p of the rail bottom c. Namely, the contact state between the support surface d and the under surface p does not become a contact state at a position which is the best for perfect fixing of the skeleton of the track, but it becomes the unstable contact state wherein the contact portions of the surfaces p and d may easily be varied under the influence of the pressing conditions of the pressing washers and external forces.

(B) Further, since the upper surfaces m of the rail bottom c are finished in the same manner as that of the under surface p of the rail bottom, where the pressing washers j are pressed by means of the pressing nuts i, the pressing portions k present a state of plane contact, line contact or sometimes spot contact according to the pressing conditions of the pressing nuts i. In anycase, it is difficult to say that the pressing portions are fixed. Particularly, where the pressing washers are made thin, it tends to present an unstable spot pressing state since the pressing washers may easily be bent or deformed.

(C) Additionally, since the support bolt h is screwed with both sides of the support plate e respectively, it is practically impossible to adjust the four support bolts h of both of the rail support devices, which are opposite to each other, to be in such a screwed state that all of the support bolts h receive an equal load. Therefore, referring to each of the rail support devices, any one of the support bolts (two support bolts in total) supports the load of the skeleton of track mainly.

Since the conventional rail support device includes the above mentioned unstable factors, where the device is mounted on the skeleton of the track by setting the rail bottom portion c on the support surface portion of the support plate e and pressing the pressing washer j by means of the pressing nut i, the supporting condition of the rail is varied unstably under the influence of external forces such as adjusting works of adjacent support devices and vibrations at the time of concrete deposition, though the rail bottom portion c is being supported by the support surface portion d. As the result, each of the rail support devices mounted on the rail, continues always to be under unstable conditions and it is impossible to adjust height and low of the skeleton of the track or cant correctly and fix the skeleton of the track completely in a predetermined place.

Therefore, when laying a track by using the conventional rail support devices, prior to concrete deposition of the concrete bed, it was necessary to fix the skeleton of the track supplementally by utilizing a number of auxiliary members under the state that the skeleton of the track was supported by the rail support devices.

Thus, in such a conventional method for fixing the skeleton of the track by using a number of auxiliary members, there occurred not only a problem that it was difficult to lay a track with high precision due to increase of the unstable factors, but also problems that it took a lot of time for the auxiliary works and that its track laying efficiency became down and needed a long term of works so that its laying cost increased.

SUMMARY OF THE INVENTION

The present invention has an object to provide a rail support adjusting and fastening device (This is called as "the device" hereinafter), which may adjust the skeleton of track precisely and efficiently and reduce laying costs for a direct fastened track and shorten a term of works.

In order to achieve the above object, the rail support adjusting and fastening device of this invention which is used in a state that the gage and tilting of the rails are adjusted in advance by means of cross ties or connecting members 3 for parallel rails 2 when laying a direct fastened track, comprises:

a rail support plate 8 for supporting an under surface 6 of a bottom portion 5 of the rail in a state of spot support, said rail support plate having at the outer side portion thereof a screwed portion 15 where a screw hole 16 is formed to extend vertically, a supporting bolt 11 having an upper screwed portion 17 at an upper portion thereof to be screwed with the screw hole 16 and a lower portion formed to be tapered to gradually slender downwardly and constructed such that the height of the rail support plate 8 may be adjusted with variation of the screwing conditions of the supporting bolt 11, three spot supporting portions 7 projected from upper outside portions and an upper inside portion of the rail support plate 8 to form each point of a triangle so as to support the under surface 6 of the rail bottom 5 in the state of three points at the inside portion and the outside portion of the under surface 6, said three spot supporting portions 7 being provided with rail spot support surfaces so as to form a plane which is tilted to fit the tilting of the rail, inside and outside spot pressing portions 10 provided with the rail support plate 8 to press the inside portion and the outside portion of the upper surface 9 of the rail bottom portion 5 in the state of spot support, said inside and outside spot pressing portions being made rigidly so as not to deform at the time of pressing, said inside and outside spot pressing portions being further constructed to press the inside portion and outside portion of the upper surface 9 of the rail bottom portion 5 in such a state that all of the three spot supporting portions 7 may contact the under surface 6 of the rail bottom portion 5 at an intermediate portion between the two spot supporting portions 7 adjacent in a longitudinal direction of the rail and also at both side portions of the spot supporting portion opposite to said two spot supporting portions 7, said spot pressing portion 10 for pressing the upper surface 9 of the rail bottom portion 5 at the intermediate portion between the spot supporting portions adjacent to one another, being provided with the rail support plate 8 integrally, and said two spot pressing portions 10 for pressing the upper surface 9 of the rail bottom portion 5 at the both side portions of the spot supporting portion, being constructed to be movable pressing section, said movable pressing section including a pair each of pressing bolts 27 and pressing members 25, said each pressing member 25 being provided with a base portion 20 of semicircle which is engaged with an engaging step 22 formed at an upper surface portion of the inside of the rail support plate 8, and provided with a forward end under surface portion 21 to be in contact with the upper surface 9 of the rail bottom portion in the state of spot contact, and also provided with an elongated bolt hole 23 to penetrate itself vertically which bolt hole is elongated in inside and outside directions of the rail 2, and said each pressing bolt 27 being constructed to be screwed with each of screw holes 26 of the rail support plate 8 through each of the elongated bolt holes 23, so that each of the forward end under surface portions 21 of the pressing members 25 may press the upper surface 9 of the rail bottom portion 5 in the state of spot pressing.

Since the device of this invention is constructed as mentioned above, when a direct fastened track is laid, the present invention may adjust the skeleton of the track precisely and efficiently and support and fix the adjusted skeleton of the track stably and reduce a cost for laying the direct fastened track and shorten a term of works. These advantages will be described in detail as follows:

(1) The device according to this invention supports the under surface of the rail bottom portion by means of the three fix spot supporting portions which are provided with the rail support plate in a state of spot support, and presses the upper surfaces of the rail bottom portion by means of the spot pressing portions in a state of three point press. Each of the devices and the rails become in a complete fixed condition by means of a fix triangle which is tilted to accord with the tilting of the rails and located within the same plane which is formed by the upper surfaces of the three spot supporting portions or by the under surfaces of the three spot pressing portions, and another fix triangle which is located within the same vertical plane which is formed by the upper surfaces of the spot supporting portions and also by the under surfaces of the spot pressing portions.

Therefore, according to the device of this invention, it becomes possible to precisely carry out the adjustments of height and low of the skeleton of a track and a cant with easy and simple operations without aid of auxiliary members used in the conventional device, and the skeleton of track may be supported and fixed stably as it is adjusted. Accordingly, it becomes possible to lay a track precisely by depositing a concrete bed.

Further, since it is almost unnecessary to use the auxiliary members, it becomes possible to reduce laying costs and shorten a term of works.

(2) The device of this invention comprises a movable pressing member, which is operable by means of the pressing bolt, as a part of the spot pressing portion for pressing the upper surface of the rail bottom portion. Therefore, it becomes possible to press easily and strongly the upper surface of the rail bottom portion in the state of spot by utilizing the pressing force of the pressing bolt effectively.

(3) In the device of this invention, since rigidity of the spot pressing portion is great, there is no problem that the pressing portion is broken as in the case of the conventional device which is using a deformable or bendable pressing washer. Therefore, the device of this invention may be used repeatedly many times and superior to durability.

BRIEF DESCRIPTION OF THE DRAWINGS

The drawings show an embodiment of the device according to this invention in which.

DETAILED DESCRIPTION OF THE EMBODIMENT

Figure 1:
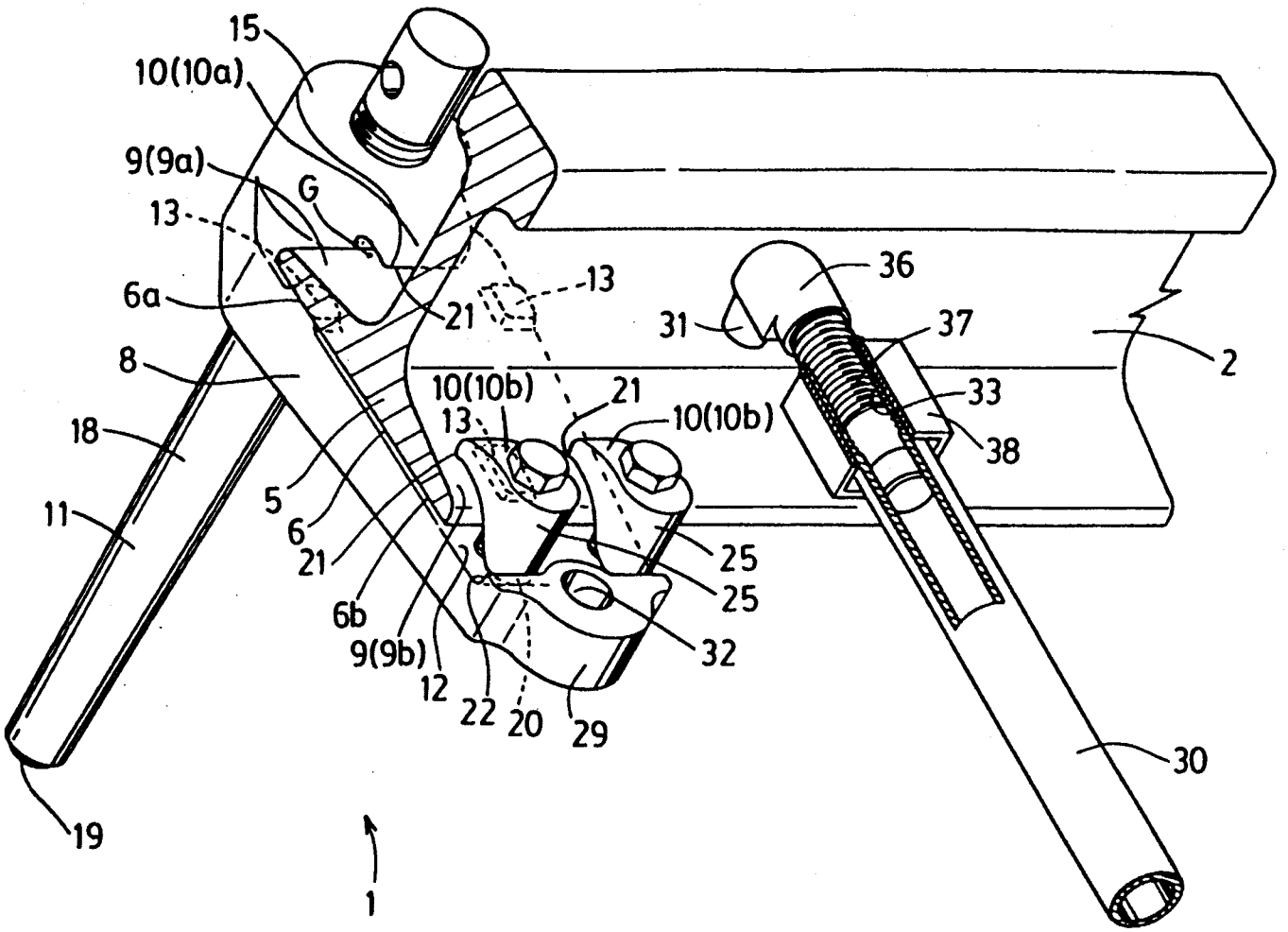
FIG. 1 is a perspective view of the device showing together with a part of a gage tie.

As shown in FIGS. 1 through 4, a rail support adjusting and fastening device 1 according to the present invention is used in a state that the gage and tilting of the rails are adjusted briefly in advance by means of connecting members 3(for instance cross ties) for parallel rails 2 when laying a direct fastened track. A rail support plate 8 is provided with projecting spot supporting portions 7 for supporting an under surface of a rail bottom portion 5 in the state of spot support. The rail support plate 8 is provided with a removable spot pressing portion 10 at the inside and an undercut fixed outside portion thereof. The spot pressing portions 10 are made rigidly and constructed to support the inside and outside portions of upper surfaces 9 of the rail bottom portion 5 in the state of spot support. The rail support plate 8 is provided with a screw threaded portion at the outside portion thereof, with which a supporting bolt 11 is screwed, and the height of the rail support plate 8 may be adjusted by varying the screwing conditions of the supporting bolt 11.

Figure 2:
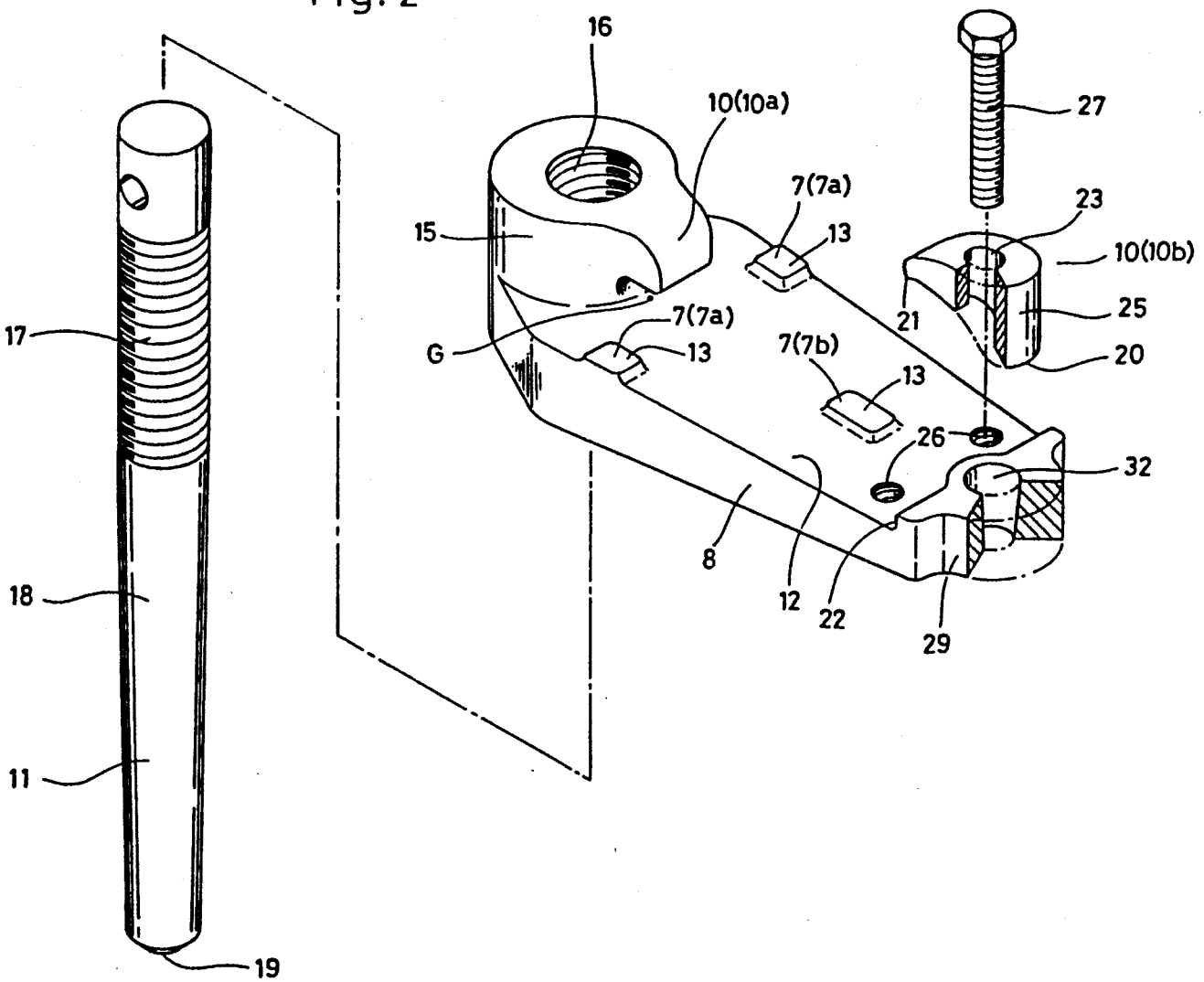
FIG. 2 is a perspective view of the device disassembled.

As shown in FIG. 2, the rail support plate 8 is made to be a rectangular plate which is long in cross directions and gradually slender toward a forward end thereof. An upper surface 12 of the rail support plate 8 is formed to be a tilted surface which is accorded with tilting of the rail 2. Two spot supporting portions 7*a* are made to project from the both sides of a center line the outside portion of the tilted upper surface 12 and a single spot supporting portion 7*b* is made to project from substantially an intermediate portion of the inside portion of the upper surface 12 so as to form each point of a triangle. Each of upper surfaces 13 of the two outside spot supporting portion 7*a* contacts an outside portion 6*a* of the under surface of the rail bottom portion 5 and an upper surface 13 of the inside spot supporting portion 7*b* contacts an inside portion 6*b* of the under surface of the rail bottom portion 5. In this embodiment, each of the three spot supporting portions 7*a*, 7*a* and 7*b* is formed to be a trapezoid having the upper surfaces 13 of relatively small area, considering its durability. The three spot supporting portions 7*a*, 7*a* and 7*b* are arranged to form each of an isosceles triangle. The rail support plate 8 is provided with a threaded portion 15 at the outside portion thereof and the threaded portion has a boss of a pillar which is extending vertically. A screw hole 16 is formed with the threaded portion 15 to extend vertically. A supporting bolt 11 has an upper threaded portion 17 at the upper portion thereof and the lower portion of the upper threaded portion 17 is formed to be slender gradually and downwardly so as to form a tapered shaft 18 and further a lower end 19 thereof is formed to have a semicircular surface. The upper threaded portion 17 of the supporting bolt 11 is screwed with the screw hole 16. Further, the up and down length of the upper threaded portion 17 is determined to be able to adjust the height of the skeleton of the track and a cant by varying the screwing conditions of the upper threaded portion 17 with respect to the screw hole 16.

The spot pressing portion 10 is constructed as a fixed pressing portion 10*a* which is arranged at an intermediate portion between the two outside spot supporting portions 7*a* and 7*a* and also as a port of movable pressing portions 10*b* which is arranged at both side portions of the inside spot supporting portion 7*b*, and the spot pressing portion is made to have rigidity not to be deformable or bendable when pressing the upper surface 9 of the rail bottom portion 5. The fixed pressing portion 10*a* is formed to be integral with the threaded portion 15 in such a state that it projects inwardly at the upper portion of the threaded portion 15, and an outside portion 9*a* of the upper surface 9 of the rail bottom portion 5 is pressed by an under surface 21 of the fixed pressing portion in the state of spot press. Each of the movable pressing portions 10*b* has a base portion 20 of semicircle which is engaged with an engaging step portion 22 in the state of spot contact, which engaging step portion is formed with the inside portion of the upper surface of the rail support plate 8. Each of the movable pressing portion 10 has a forward end under surface 21 which is constructed to contact an inside portion 9*b* of the upper surface 9 of the rail bottom portion 5. Thus, the movable pressing portion 10*b* forms a triangle block, the forward end of which is bent to form a bill. An elongated bolt hole 23 penetrates each of the two pressing members 25 vertically and respectively which hole is elongated in the directions of the inside and outside of the rail 2. Each of the pressing members 25 is mounted onto the rail support plates 8 by means of a pressing bolt 27 which is threaded with a screw hole 26 of the rail support plate 8 through the elongated bolt hole 23. The tip and under surface 21 of the pressing member 25 presses the inside portion 9*b* of the upper surface of the rail bottom portion 5 by screwing and pressing the pressing bolt 27 in the state of spot press.

Figure 3:
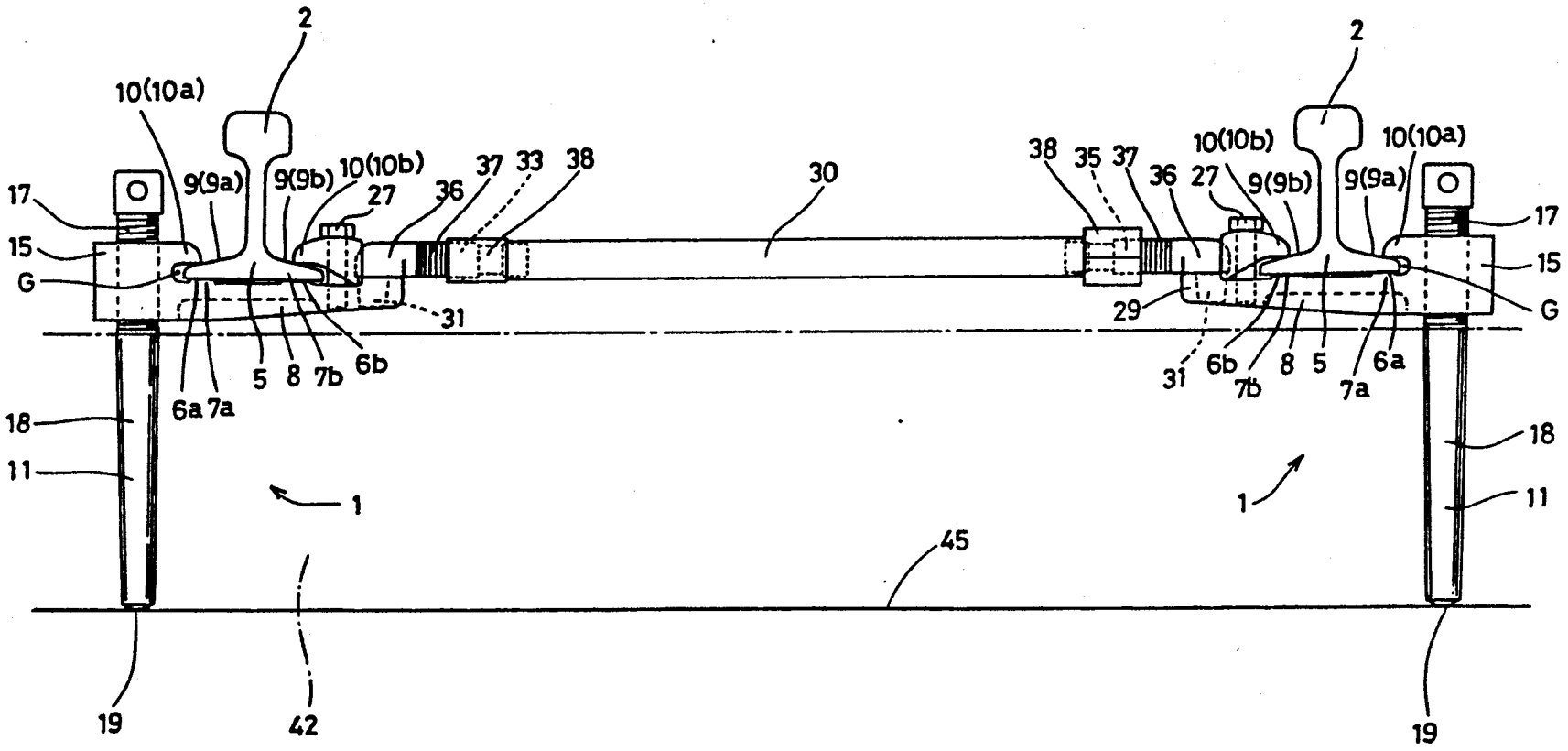
FIG. 3 is a front view of the device showing a state of use.

In this embodiment, the rail support plate 8 has a gage tie engaging portion 29 at the inside portion thereof, which gage tie engaging portion is provided with a hole portion 29 for inserting therein a shaft 31 of an end of a gage tie 30 which is used for precisely adjusting and fixing the gage of the rails which gage is briefly adjusted by means of the connecting members 3. As shown in FIGS. 1 and 3, the gage tie 30, for instance, comprises a hollow pipe which has a left side portion 33 having a female screw and a right side portion 35 having also a female screw whose screws are formed in opposite directions to each other, a screw shaft 36 of L-letter shape having a male screw 37, which screw shaft is connected to the shaft 31 at the forward end thereof, and square tubes 38 which are secured to both of the ends of the hollow pipe. The gage tie 30 may be shortened and lengthened with rotation of the square tubes 38 by means of a wrench.

Figure 4:
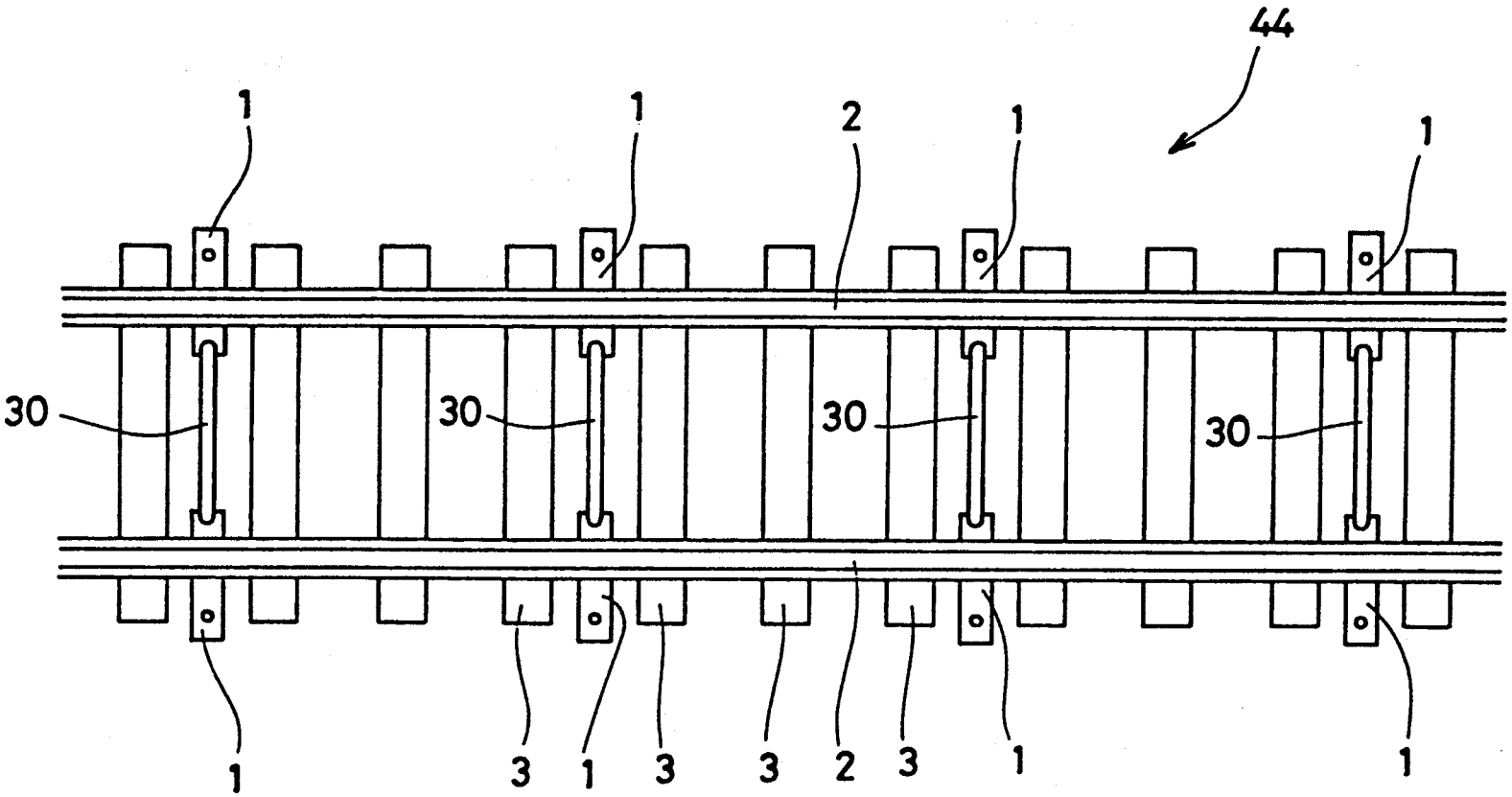
FIG. 4 is a plan view of the device showing the state of use.

Next, according to the device 1 in this embodiment, the steps of adjustments of the height and low and also a cant of the skeleton of the track will be described with reference to FIGS. 3 and 4. First, the skeleton of track is prepared by connecting the parallel rails 2 by means of the connecting members 3 and the gage of the rails and tilting of each of the rails are breifly adjusted in advance. Thereafter, the rail bottom portion 5 is mounted on the rail support plate 8 of the device 1 at the positions of the parallel rails which are opposite to each other. At the time the device 1 is screwed with the supporting bolt 11 (This bolt is standing on a concrete bed surface 45.) and the two pressing members 25 are removed therefrom. At the time of mounting the rail bottom 5, the outside portion of the rail bottom 5 is inserted into a clearance G which is formed between the rail support plate 8 and the fixed pressing portion 10*a*. When the rail bottom plate 5 is mounted in such a manner, the rail bottom portion 5 may be supported stably by the wide rail support surface as the same plane which includes the upper surfaces 13 of the three spot supporting portions 7*a*, 7*a* and 7*b* (The support surface is tilted to accord with the tilting of the rail.). Accordingly, the under surface 6 of the rail bottom portion 5 becomes in a state that it seems to be supported to fit the upper surafce 12 of the rail support plate 8. Thereafter, both of the pressing members 25 are attached to both sides of the inside portion of the rail support plate 8 by means of the pressing bolts 27 in such a manner that the forward end lower surface 21 may contact the inside portion 9*b* of the upper surface 9 of the rail bottom portion 5. At the time the pressing bolts 27 are inserted into the elongated bolt holes 23 and screwed with the screw holes 26 of the rail support plate 8. Each of the pressing bolts 27 is screwed suitably in the directioin of tightening and then the semicircular base portion 20 of the pressing member 25 may be engaged with the engaging step 22 in the state of spot contact, as mentioned above. Therefore, the forward end surface 21 of the pressing member 25 may smoothly press the inside portion 9*b* of the upper surface of the rail bottom portion 5 in the state of spot contact. The under surface 21 of the fixed pressing portion 10*a* presses the outside portion 9*a* of the upper surface 9 in the state of spot press. As the result, the upper surface 9 of the rail bottom portion 5 is pressed by the three spot pressing portions 10*a*, 10*b* and 10*b* so as to maintain a stable support by means of the three spot supporting portions 7*a*, 7*a* and 7*b*. As is described hereinbefore in the item of function or summary, the upper surfaces 13 of the three spot supporting portions 7*a*, 7*a* and 7*b* form a fixed triangle which is in the same plane which is tilted to accord with the tilting of the rail. The upper surface 13 of the spot supporting portion 7*b* and the under surfaces 21 of the spot pressing portions 10*b* or the upper surfaces 13 of the spot supporting portions 7*a* and 7*a* and the under surface 21 of the spot pressing portion 10*a* form a fixed triangle which is in a plane which is substantially vertical. The device 1 and the rail 2 become in a fixed state completely with such a triangle. Each of the devices 1 mounted on the opposite rails may support and fix the skeleton of the track stably in an adjustment state and therefore the track may be laid precisely by depositing a concrete bed 42. If it is required, each of the gage ties 30 may be mounted between the opposite devices 1 by inserting the shaft 31 into the hole portion 32 and fixing same, and then the gage tie 30 may be shortened and lengthened suitably by rotating the square tube 38 by means of a wrench so as to fix the gage of the rails in the precisely adjusted state until the concrete bed 42 is hardened.

After hardening of the concrete bed 42, the spot pressing members 10*b* are removed and the supporting bolt 11 is rotated in a direction that it goes up and then it is drawn out and the rail supporting plate 8 is drawn outwardly and removed (The withdrawal of the supporting bolt 11 may be smoothly carried out since the lower portion 18 of the supporting bolt 11 is tapered.). By the way, when the gage tie 30 is mounted, the shaft 31 is removed from the hole portion 32 prior to removable of the rail supporting plate 8.

Figure 5:
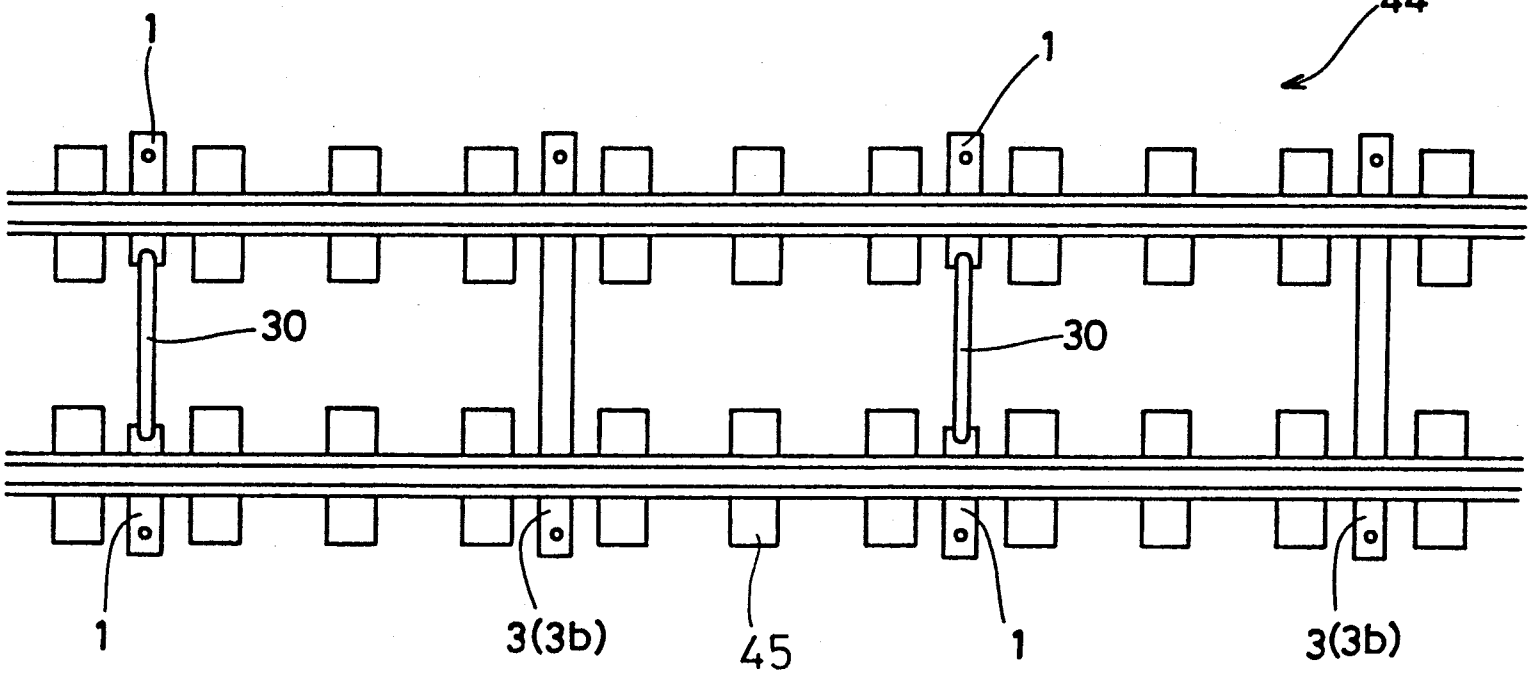
FIG. 5 is a plan view of the device showing another state of use.
Figure 6:
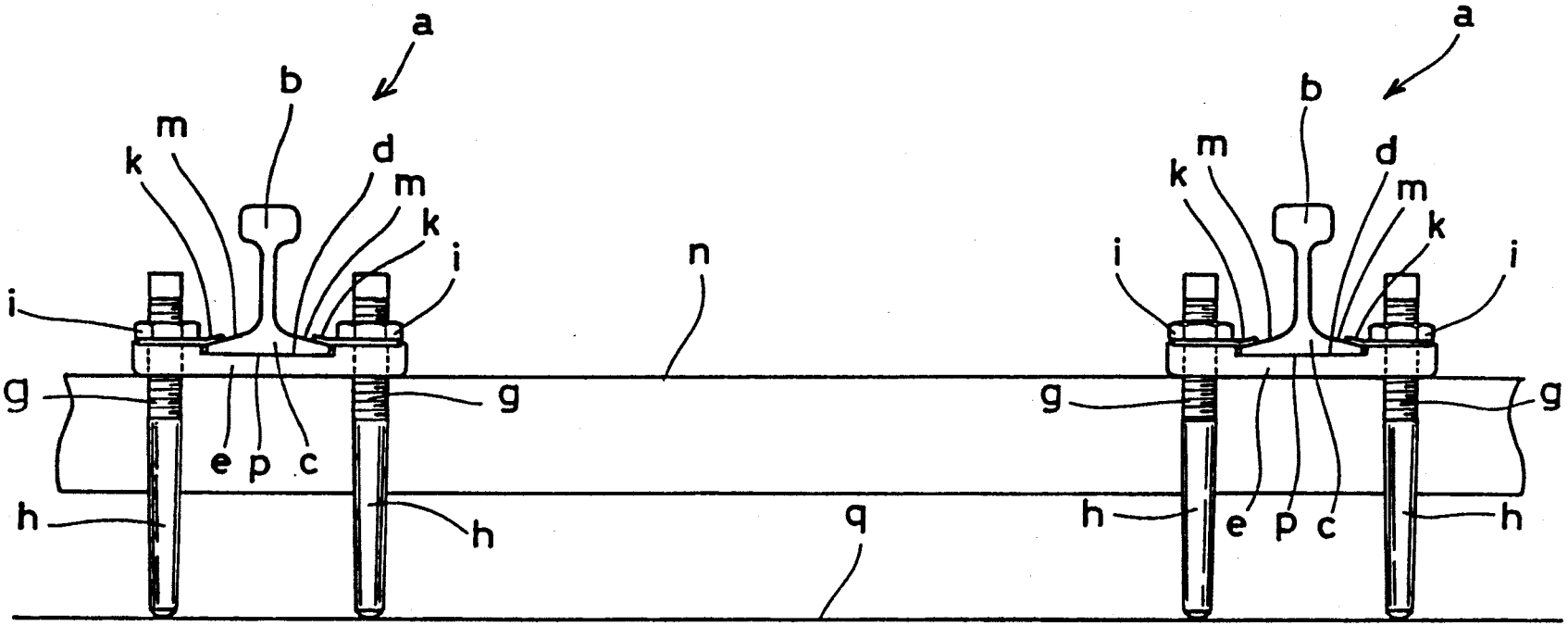
(Prior Art) Fig. 6
FIG. 6 is a front view of a conventional device showing a state of use.
Figure 7:
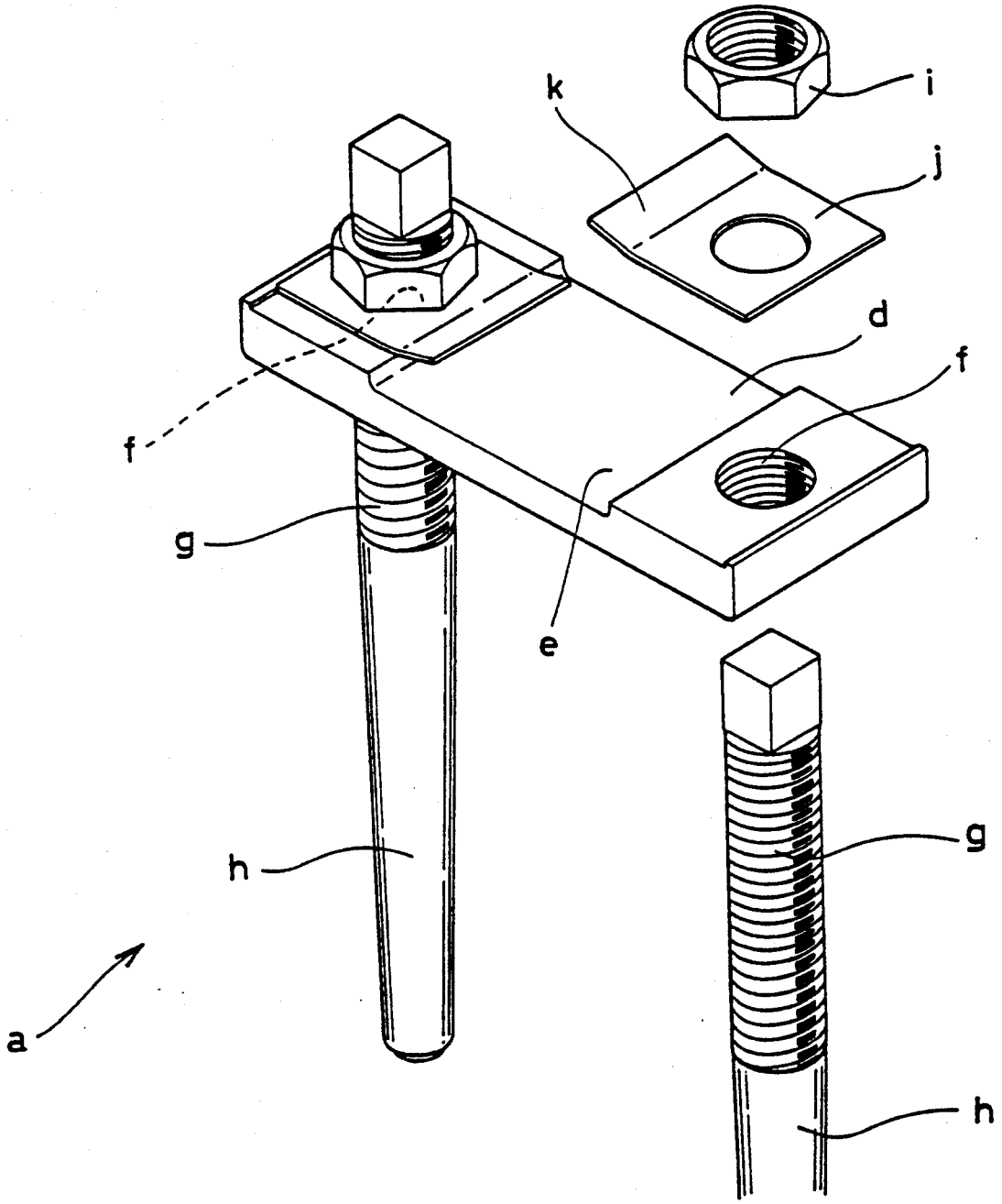
(Prior Art) Fig. 7
FIG. 7 is a perspective view of the conventional device disassembled.
Figure 8:
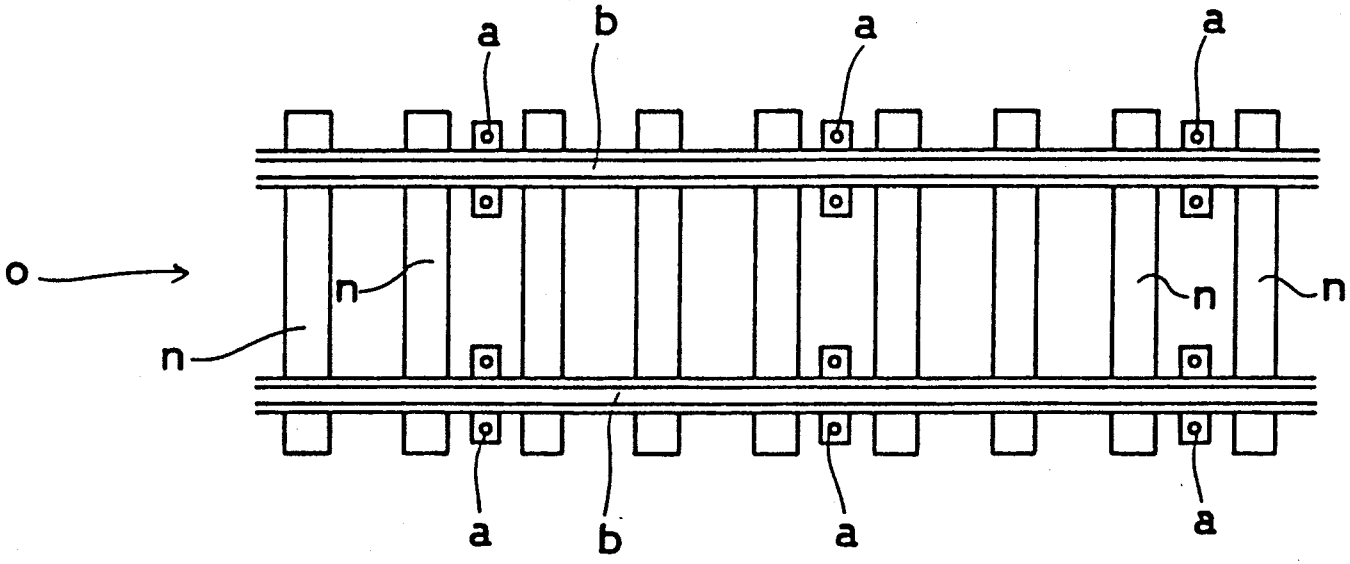
(Prior Art) Fig. 8
FIG. 8 is a plan view of the conventional device showing the state of use.

FIG. 5 shows a block tie 45 as a tie and the tie means the connecting members 3 for connecting the rails 2 to each other.

Next, operations of the above embodiment will be described below.

When the height of the skeleton of track and a cant are required to be adjusted by using the device 1 of this invention, first, the skeleton of track is prepared by connecting the parallel rails 2 by means of the connecting members 3 and the gage of the rails and tilting of each of the rails are briefly adjusted in advance. Thereafter, the rail bottom portion 5 is mounted on the rail support plate 8 of the device 1 at the positions of the parallel rails which are, for instance, opposite to each other. At the time the device 1 is screwed with the supporting bolt 11 (This bolt is standing on a concrete bed surface 45.) so that the inside and outside portions of the upper surface 9 of the rail bottom portion may be in a pressed state by the spot pressing portion 10.

As shown in FIG. 1, where the under surface 3 is supported with three points and the upper surface 9 is also supported with three points, the under surface 6 is supported stably by the wide rail support surface which forms the same plane including the upper surfaces 13 of the three spot supporting portions 7, said wide rail support surface being tilted to accord with the tilting of the rail, as if the under surface 6 of the rail bottom portion 5 fit the upper surface 12 of the rail supporting plate 8 and was supported thereby. As the result, the upper surfaces 13 of the three spot supporting portions 7*a*, 7*a* and 7*b* form a fixed triangle which is in the same plane which is tilted to accord with the tilting of the rail. The upper surfaces 13 of the spot supporting portion 7 and the under surface 21 of the spot pressing portions 10 form a fixed triangle which is in a plane which is substantially vertical. The device 1 and the rail 2 become in a fixed state completely with such a triangle. Each of the devices 1 mounted on the opposite rails may support and fix the skeleton of track 44 stably in an adjusted state and therefore the track may be laid precisely by depositing a concrete bed 42.

What is claimed is:

1. A rail support adjusting and fastening device for parallel rails of a directly fastened track which is used to adjust a gage and tilting of the rails prior to laying the track, comprising:

a rail support plate (8) for supporting an under surface (6) of a bottom portion (5) of the rail in a state of a spot support, said rail support plate having at an outer side portion thereof a threaded portion (15) where a screw hole (16) is formed to extend vertically, a supporting bolt (11) having an upper threaded portion (17) at an upper portion thereof to be threaded with the screw hole (16) and a lower portion of said bolt is formed to be tapered to gradually become more slender downwardly and constructed such that the height of the rail support plate (8) can be adjusted by rotation of the supporting bolt (11), two spot supporting portions (7) projected from upper outside portions and one spot supporting portion projecting from an upper inside portion of the rail support plate (8) to form points of a triangle so as to support the under surface (6) of the rail bottom (5) at three points on the under surface (6) of the rail bottom, each of said spot supporting portions (7) being provided with rail spot support surfaces so as to form a plane which is tilted to fit a tilting of the rail, inside and outside spot pressing portions (10) provided with the rail support plate (8) to press the inside portion and the outside portion of the upper surface (9) of the rail bottom portion (5) in the state of spot supporting, said inside and outside spot pressing portions being made rigidly so as not to deform at a time of being pressed by said pressing portions, said inside and outside spot pressing portions being further constructed to press the inside portion and outside portion, respectively, of the upper surface (9) of the rail bottom portion (5) at an intermediate portion between the two spot supporting portions (7) adjacent in a longitudinal direction of the rail and at both side portions of the one spot supporting portion opposite to said two spot supporting portions (7) respectively, such that all three spot supporting portions contact the under surface of the rail bottom portion, said spot pressing portions (10) for pressing the upper surface (9) of the rail bottom portion (5) at the intermediate portion between the two spot supporting portions adjacent to one another being provided with the rail support plate (8) integrally, and said inside and outside spot pressing portions (10) for pressing the upper surface (9) of the rail bottom portion (5) at both side portions of the one spot supporting portion being constructed to be a movable pressing section, said movable pressing section including a pair of pressing bolts (27) and pressing members (25), said each pressing member (25) being provided with a base portion (20) of a semicircle configuration which is engaged with an engaging step (22) formed at an upper surface portion of the inside of the rail support plate (8), and provided with a forward end under surface portion (21) to be in contact with the upper surface (9) of the rail bottom portion, and also provided with an elongated vertically extending bolt hole (23) adapted to receive a pressing bolt therethrough, said rail support plate including pressing bolt screw holes, and said each pressing bolt (27) being constructed to be screwed with each of said pressing bolt screw holes (26) of the rail support plate (8) through each of the elongated bolt holes (23), so that each of the forward ends under surface portions (21) of the pressing members (25) press the upper surface (9) of the rail bottom portion (5) onto the spot pressing portions.

2. The device as claimed in claim 1 wherein each of the spot pressing portions (10) comprises a pressing member and a bolt.

3. The device as claimed in claim 2 wherein the two spot pressing portions (10) which are located at the inside of the rail (2) comprise a pair each of pressing members and bolts.

* * * * *